US007796771B2

(12) United States Patent
Calhoun et al.

(10) Patent No.: US 7,796,771 B2
(45) Date of Patent: Sep. 14, 2010

(54) BONE CONDUCTION HEARING AID FASTENING DEVICE

(75) Inventors: Roberta A. Calhoun, 6602 Springvale Dr., Pittsburgh, PA (US) 15236; Jon Hummer, East Millsboro, PA (US)

(73) Assignee: Roberta A. Calhoun, Pittsburgh, PA (US)

( * ) Notice: Subject to any disclaimer, the term of this patent is extended or adjusted under 35 U.S.C. 154(b) by 1059 days.

(21) Appl. No.: 11/507,260

(22) Filed: Aug. 21, 2006

(65) Prior Publication Data

US 2007/0071258 A1 Mar. 29, 2007

Related U.S. Application Data

(60) Provisional application No. 60/721,263, filed on Sep. 28, 2005.

(51) Int. Cl.
*H04R 25/00* (2006.01)

(52) U.S. Cl. ..... 381/326; 381/322

(58) Field of Classification Search ..... 381/312, 381/322, 326, 328; 600/25; 2/171
See application file for complete search history.

(56) References Cited

U.S. PATENT DOCUMENTS

| | | | |
|---|---|---|---|
| 4,498,461 | A | 2/1985 | Hakansson |
| 4,612,915 | A | 9/1986 | Hough et al. |
| 4,904,233 | A | 2/1990 | Hangkansson et al. |
| 4,918,757 | A | 4/1990 | Janssen et al. |
| 2004/0062411 | A1 | 4/2004 | Retchin et al. |

*Primary Examiner*—Tuan D Nguyen
(74) *Attorney, Agent, or Firm*—Robert P. Lenart, Esq.; Pietragallo Gordon Alfano Bosick & Raspanti, LLP

(57) ABSTRACT

A fastening device for a bone conduction hearing aid comprises a first end portion, a second portion structured and arranged to be coupled to a bone conduction hearing aid, and a transition portion that connects the first and second end portions.

13 Claims, 2 Drawing Sheets

BONE CONDUCTION HEARING AID FASTENING DEVICE

CROSS-REFERENCE TO RELATED APPLICATION

This application claims the benefit of U.S. Provisional Patent Application Ser. No. 60/721,263 filed Sep. 28, 2005, which is incorporated herein by reference.

FIELD OF THE INVENTION

This invention relates to hearing aid fastening devices, and more particularly to fastening devices that allow a bone conduction hearing aid to be interchangeably coupled with various headwear.

BACKGROUND OF THE INVENTION

External bone conduction hearing aids function by transmitting vibrations through the skull to the cochlea. In order to function properly, a portion of the bone conduction hearing aid must be in constant contact with the head in order to transmit the vibrations to the bone of the wearer. Because the bone conduction hearing aid must be held against the head, significant pressure is required to hold the base of the hearing aid in place. Conventional bone conduction hearing aid devices are typically held in contact with the wearer's skull by a fastening stud embedded in the mastoid bone of the wearer, a headband made of spring metal, or by a tightly fitted elastic headband. Infants and small children typically cannot have a fastening stud embedded in their skull because the skull is not hard enough to support the stud. Accordingly, infants and small children must typically wear headbands secured against the wearer's skull. As a result of head movement, children must often use double-stick tape to secure the device to the head. The use of tape on a wearer's head often results in red sore spots, allergic skin reactions to the tape, and/or the pulling out of the wearer's hair. Because the headband must be tightly fitted on the wearer's head, the headband can also cause painful indentations on the wearer's head and pressure headaches.

The elastic headbands conventionally used to hold a bone conduction hearing aid in contact with the skull of a wearer are typically made of stiff brightly colored narrow elastic. These devices cannot be moved from the elastic headband to other conventional headwear such as hats or bonnets. Bone conduction hearing aids include a microphone that must be exposed to the air in order to properly receive vibrations. Accordingly, hats and the like cannot be placed over conventional elastic headbands that restrain a bone conduction hearing aid against a wearer's skull because the microphone would be blocked.

A need remains for a hearing aid fastening device that allows a wearer to wear both a bone conduction hearing aid and conventional headwear such as hats or bonnets or the like.

SUMMARY OF THE INVENTION

In a first aspect, the invention provides a fastening device for a bone conduction hearing aid. The fastening device comprises a first end portion, a second end portion structured and arranged to be coupled to a bone conduction hearing aid, and a transition portion that connects the first and second end portions.

The transition portion has a cross-sectional area that is smaller than the cross-sectional area of the first end portion, and the cross-sectional area of the second end portion. The fastening device is structured to be mounted in an article of clothing, or the like, such that the first end portion is positioned adjacent to an interior surface of the article of clothing, and the second end portion is positioned adjacent to an outside surface of the article, with the transition portion passing through the article of clothing. The fastening device serves as a transducer for transmitting vibration from the hearing aid to the wearer.

In another aspect, the invention provides a fastening device for a bone conduction hearing aid comprising a first end portion and a stud extending from the first end portion, wherein the stud has a sufficient length to pass through an article of clothing or the like, and the stud is structured and arranged to be coupled to a bone conduction hearing aid.

DETAILED DESCRIPTION OF THE INVENTION

Figure 1:
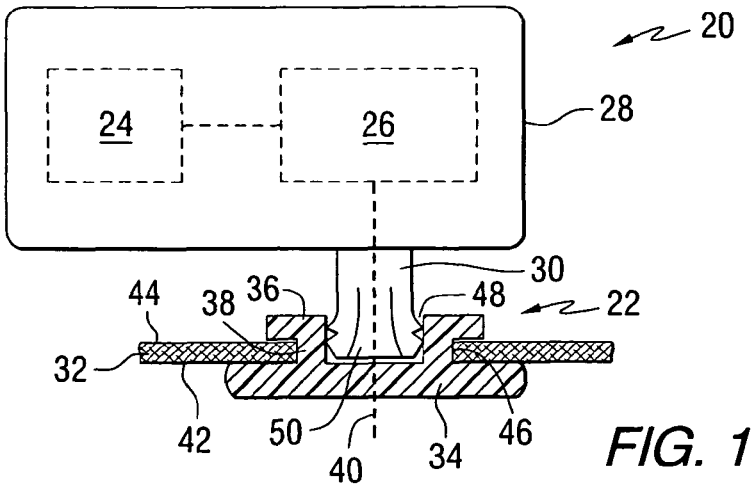
FIG. 1 is a schematic representation of a conventional bone conduction hearing aid and a fastening device in accordance with an embodiment of the invention.
Figure 2:
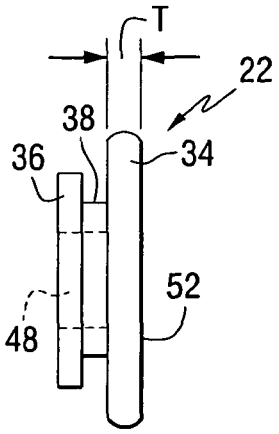
FIG. 2 is a side view of a fastening device in accordance with an embodiment of the invention.
Figure 3:
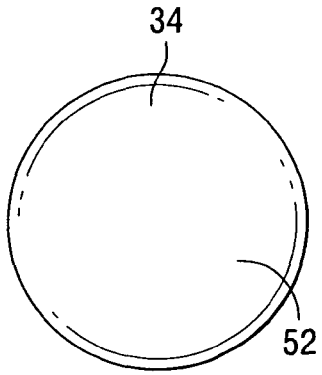
FIG. 3 is an end view of the fastening device of FIG. 2.
Figure 4:
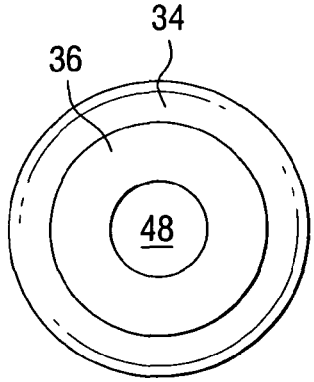
FIG. 4 is another end view of the fastening device of FIG. 2.

The invention is directed to a fastening device for a bone conduction hearing aid. FIG. 1 is a schematic representation of a conventional bone conduction hearing aid and a fastening device in accordance with an embodiment of the invention. FIG. 2 is a side view of a fastening device in accordance with an embodiment of the invention, and FIGS. 3 and 4 are end views of the fastening device of FIG. 2.

As shown in FIG. 1, a conventional bone conduction hearing aid 20 is coupled to a fastening device 22 in accordance with an embodiment of the invention. The bone conduction hearing aid 20 is a commercially available device that typically comprises a microphone 24 and a vibration-generating device 26 in a housing 28. The vibration-generating device is coupled to a stem 30. Other components including a battery and sound processing circuitry may also be contained in the housing as is known in the art.

This invention provides a fastening device 22 that is arranged and configured to be coupled to the stem 30 and to transmit vibration from the stem 30 to the wearer. The fastening device 22 is shaped to be mounted or positioned within an article of clothing 32 or the like. In the embodiment of FIGS. 1-4, the fastening device includes a first end portion 34, a second end portion 36 structured and arranged to be coupled to a bone conduction hearing aid, and a transition portion 38 that connects the first and second end portions. The first end portion, the second end portion, and the transition portion are positioned along a common axis 40. In this embodiment, each of the first end portion, the second end portion, and the transition portion has a generally cylindrical shape.

The transition portion has a cross-sectional area that is smaller than the cross-sectional area of the first end portion, and the cross-sectional area of the second end portion. The fastening device is structured to be mounted in an article of clothing 32, or the like, such that the first end portion is positioned adjacent to an interior surface 42 of the article of clothing, and the second end portion is positioned adjacent to an outside surface 44 of the article of clothing, with the transition portion passing through an opening 46 in the article of clothing.

The fastening device 22 can be positioned at any desired location, for example, such that a contact surface 52 is positioned adjacent to a mastoid bone of the wearer. The stem 30 is coupled to the fastening device 22 in a manner such that vibration produced by the hearing aid 20 is transmitted to the fastening device 22. The fastening device 22 serves as a vibration transducer that transmits vibration from the stem 30 of the hearing aid 20 to a bone of the wearer.

In the embodiment of FIGS. 1, 2 and 4, the second end portion 36, also called the engaging end portion, includes an opening, cavity or hole 48 for receiving at least a portion of the acoustic stem 30. In one embodiment, the engaging end 36 includes a cavity 48 sized to securely house a portion of the stem 30. The stem 30 can be secured to the engaging end 36 by "press-fit" means or a physical locking mechanism. In one embodiment, the stem 30 comprises a plurality of segments 50 that are compressed together within the cavity in the engaging end 36 to secure the fastening device 22 and the hearing aid 20. The cavity can have a smooth wall, or can include ridges or grooves in the wall to engage grooves or ridges in the stem of the hearing aid. The article of clothing 32 can be, for example, headwear, such as a ball cap, bucket hat, ski hat, visor, headband, bonnet and the like.

To use the fastening device, a wearer can insert the engaging end 36 of the fastening device 22 through the hole in the article of clothing 32, and insert the stem 30 of the hearing aid at least partially within the engaging end 36 of the fastening device 22. Then the article of clothing can be positioned on the wearer. The interior surface of the article of clothing can then exert a force against the first end portion of the fastening device to keep the fastening device in contact with the wearer, such that vibration of the hearing aid stem is transmitted to the wearer. The user may rely on the fit of the clothing (e.g., a hat) to maintain the necessary pressure of the device against the head. Alternatively, the clothing can include an elastic inner band to hold the device in place, with the device going through both the inner band and the hat.

The fastening device 22 can have suitable dimensions for coupling to at least a portion of the hearing aid 20 and restraining it against the wearer. The engaging end 36 and the first end 34 can have any desired shape, such as circular, square or rectangular. While the invention is not limited to any size relationship among the elements, in one embodiment, the cross-sectional area of the first end 34 is about 1.2 times the cross-sectional area of the engaging end 36. The first end 34 preferably has a small thickness T that does not extend substantially beyond the interior surface of the article of clothing 32.

This structure defines a circumferential groove between the first end portion and the engaging end portion. When inserted in an article of clothing, the edges of an opening in the clothing can be positioned in the circumferential groove. The first end portion 34 can be large enough to prevent passage through the opening in the clothing. The second end portion 36 is generally disk-shaped. The first end portion 34 forms a wearer interface surface 52.

The fastening device 22 can be made out of any suitable material that is capable of transmitting vibration from the hearing aid 20 to the wearer, such as polymeric materials and the like. In one example, the fastening device is constructed of Ultem® polyimide thermoplastic resin, a type of amorphous polyetherimide that is commonly used in medical instrumentation. However, other materials such as nylon or polyvinylchloride can be used, and the invention is not limited to any particular type of material.

As shown in FIG. 1, the fastening device and the hearing aid can be engaged together as described above. A typical hearing aid has a stem that has a length of from about 0.25 inches to about 0.75 inches. The stem can include an end portion having ridges shaped to form a locking assembly in combination with grooves in the wall of the cavity of the fastening device. The fastening device includes an engaging end sized to accommodate a portion of the acoustic stem within the engaging end.

Figure 5:
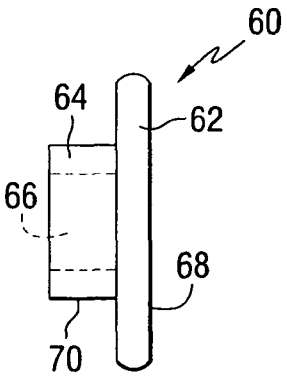
FIG. 5 is a side view of a fastening device in accordance with another embodiment of the invention.
Figure 6:
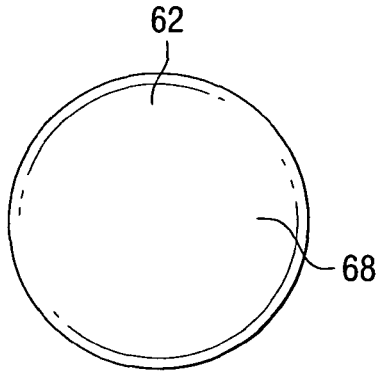
FIG. 6 is an end view of the fastening device of FIG. 5.
Figure 7:
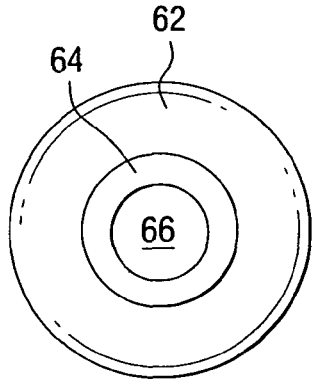
FIG. 7 is another end view of the fastening device of FIG. 5.

FIG. 5 is a side view of a fastening device 60 in accordance with another embodiment of the invention. FIGS. 6 and 7 are end views of the fastening device of FIG. 5. In this embodiment, the fastening device includes a first end portion 62 and a stud 64 extending from the first end portion. The stud defines a cavity 66 for receiving the stem of the hearing aid. The stud has a sufficient length to extend through a hole in an article of clothing.

The diameter of the first end portion 62 is larger than the diameter of the hole such that an outside surface 70 of the stud 64 is in contact with the article of clothing, whereby the article of clothing can exert a force on the fastening device 60 to secure the wearer contact surface 68 against the wearer. Thus the shape of the first end portion 62 and the stud 64 of the fastening device 60 restrains the fastening device against an interior surface of the article of clothing. The diameter of the stud 64 is smaller than the diameter of the first end portion 62, allowing the stud to be inserted in the hole of the article of clothing.

Figure 8:
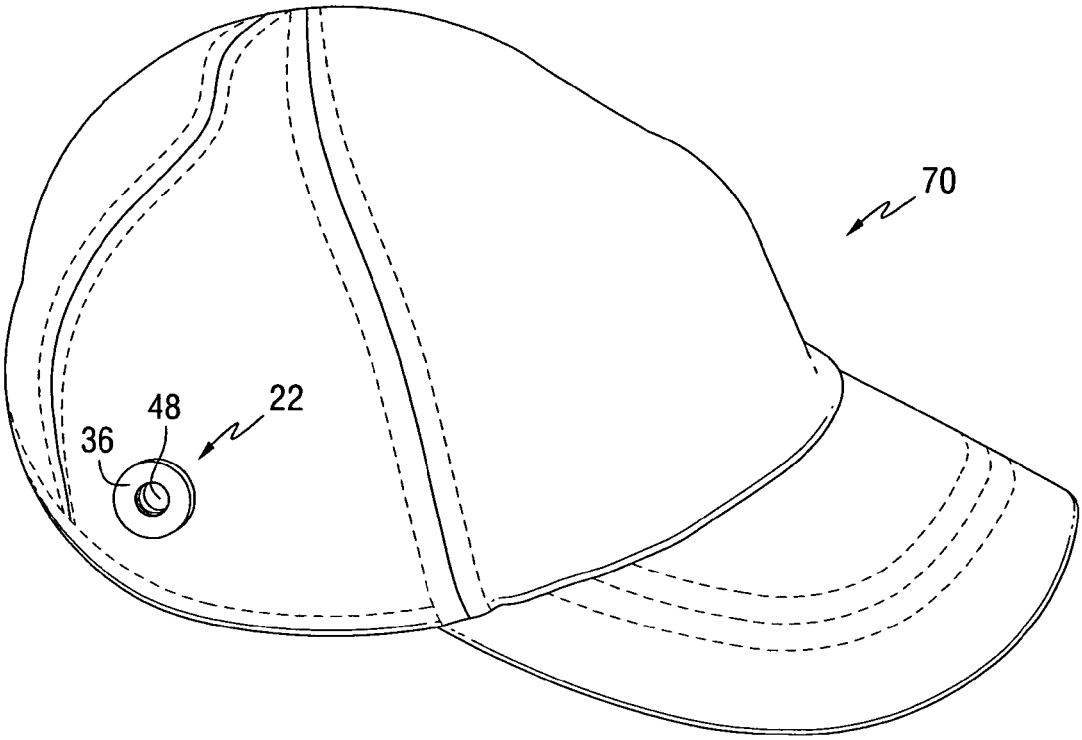
FIG. 8 is a pictorial representation of a fastening device positioned in a ball cap in accordance with an embodiment of the invention.
Figure 9:
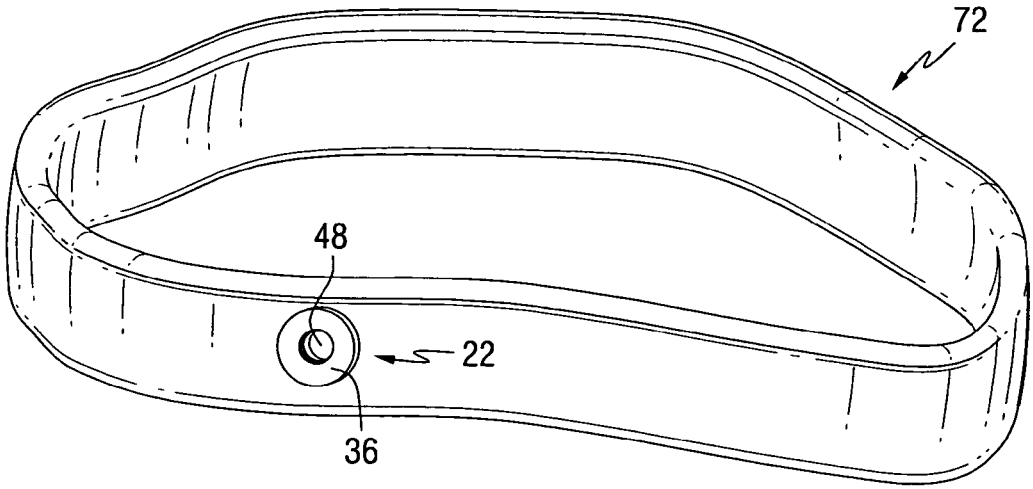
FIG. 9 is a pictorial representation of a fastening device positioned in a headband in accordance with an embodiment of the invention.

The fastening device of the invention can be easily removed from one article of clothing and repositioned on another article of clothing. For example, the fastening device can be used to secure a hearing aid to a ball cap as shown in FIG. 8. In this example, the ball cap includes a hole adjacent to the mastoid bone of the wearer, and the fastening device is mounted in the hole. The fastening device can be removed from the hearing aid and the hearing aid and fastening device can be resecured in another article of clothing. This allows the wearer to easily alter articles of clothing. The fastening device of the invention can be positioned within a variety of articles of clothing. As shown in FIG. 9, the fastening device can be mounted in a headband. In one embodiment, the fastening device and the article of clothing can be sized to accommodate small children and/or infants.

While the fastening device is shown to include a first end portion and a second end portion or stud having a generally cylindrical shape, it should be understood that other shapes fall within the scope of this invention. In addition, the wearer interface surface can be shaped to conform to a portion of the wearer's body to which the interface surface will be applied.

Whereas particular embodiments of this invention have been described above for purposes of illustration, it will be evident to those skilled in the art that numerous variations of the described embodiments can be made without departing from the scope of the invention as defined in the following claims.

What is claimed is:

1. A fastening device comprising:

a first end portion including a wearer interface surface;

a second portion structured and arranged to be coupled to a bone conduction hearing aid stem; and a transition portion that connects the first and second end portions, wherein when the fastening device is mounted in an article of clothing positioned on a wearer, the article of clothing exerts a force against the first end portion to keep the wearer interface surface in contact with the wearer such that vibration of the hearing aid stem is transmitted to the wearer.

2. The fastening device of claim 1, wherein the transition portion has a cross-sectional area that is smaller than a cross-sectional area of the first end portion, and a cross-sectional area of the second end portion.

3. The fastening device of claim 1, wherein the first end portion is positioned adjacent to an interior surface of the article of clothing, and the second end portion is positioned adjacent to an outside surface of the article of clothing, with the transition portion passing through the article of clothing.

4. The fastening device of claim 1, wherein the second end portion includes means for coupling a hearing aid to the fastening device.

5. The fastening device of claim 4, wherein the means for coupling a hearing aid to the fastening device comprises:

a cavity in the second end portion.

6. The fastening device of claim 5, wherein the cavity is cylindrical and includes a smooth interior wall.

7. The fastening device of claim 5, further comprising ridges or grooves in the cavity.

8. A fastening device comprising:

a first end portion including a wearer interface surface; and a stud extending from the first end portion, wherein the stud has a sufficient length to pass through an article of clothing, and the stud is structured and arranged to be coupled to a bone conduction hearing aid stem, wherein when the fastening device is mounted in an article of clothing positioned on a wearer, the article of clothing exerts a force against the first end portion to keep the wearer interface surface in contact with the wearer such that vibration of the hearing aid stem is transmitted to the wearer.

9. The fastening device of claim 1, wherein the stud includes means for coupling a hearing aid to the fastening device.

10. The fastening device of claim 9, wherein the means for coupling a hearing aid to the fastening device comprises:

a cavity in the stud.

11. The fastening device of claim 10, wherein the cavity is cylindrical and includes a smooth interior wall.

12. The fastening device of claim 10, further comprising ridges or grooves in the cavity.

13. A method comprising:

connecting a bone conduction hearing aid stem to a fastening device, wherein the fastening device comprises a first end portion including a wearer interface surface, a second portion structured and arranged to be coupled to the bone conduction hearing aid stem, and a transition portion that connects the first and second end portions; and mounting the fastening device in an article of clothing with the transition portion passing through an opening in the article of clothing such that when the article of clothing is positioned on a wearer, the article of clothing exerts a force against the first end portion to keep the wearer interface surface in contact with the wearer such that vibration of the hearing aid stem is transmitted to the wearer.

* * * * *